United States Patent [19]

Guerra

[11] Patent Number: 4,789,152

[45] Date of Patent: Dec. 6, 1988

[54] EXERCISE DEVICE

[76] Inventor: Donato R. Guerra, 2837 Sylvester Dr., Hartland, Wis. 53029

[21] Appl. No.: 72,874

[22] Filed: Jul. 14, 1987

[51] Int. Cl.[4] ..... A63B 21/00; A63B 69/00; A63B 3/00; A63B 11/00

[52] U.S. Cl. ..... 272/144; 272/63; 272/78; 272/113; 272/122

[58] Field of Search ..... 272/62, 63, 78, 93, 272/109, 117, 122, 123, 134, 144, 112, 113; 211/4, 8, 44

[56] References Cited

U.S. PATENT DOCUMENTS

| | | | |
|---|---|---|---|
| 3,022,072 | 2/1962 | Zinnow | 272/78 |
| 3,118,668 | 1/1964 | Callahan | 272/117 X |
| 3,207,511 | 9/1965 | Hoffman | 272/63 |
| 3,211,452 | 10/1965 | Ahrens | 272/109 X |
| 3,235,255 | 2/1966 | Leflar | 272/123 |
| 3,857,561 | 12/1974 | Cecchettini et al. | 272/63 X |
| 3,948,513 | 4/1976 | Pfotenhauer | 272/134 X |
| 4,063,646 | 12/1977 | Stahl, Jr, | 211/4 |
| 4,403,772 | 9/1983 | Stangle | 272/117 X |
| 4,620,701 | 11/1986 | Mojden | 272/63 |
| 4,662,631 | 5/1987 | Seal | 272/144 X |
| 4,720,099 | 1/1988 | Carlson | 272/144 X |

*Primary Examiner*—V. Millin
*Assistant Examiner*—Robert W. Bahr
*Attorney, Agent, or Firm*—Andrus, Sceales, Starke & Sawall

[57] ABSTRACT

An exercise device includes a pair of spaced side rails and a transverse end rail extending between the side rails. The side rails are supported so as to be capable of bearing the weight of an exerciser along their length. The side rails are spaced from a supporting surface, and are capable of adjustable up-down movement relative to the supporting surface. The transverse end rail is also capable of adjustable up-down movement relative to the spaced side rails. The side rails are closer together at one end than at the other, with the side rails including portions extending in substantially parallel relation to each other and then diverging away from each other toward the other end. The exercise device is capable of use in both an indoor and outdoor environment, and base brackets are provided to support the exercise device in either environment. The device further includes an anti-theft dumbbell rank for storage of dumbbells when the exercise device is used in an outdoor environment.

16 Claims, 2 Drawing Sheets

FIG. 1
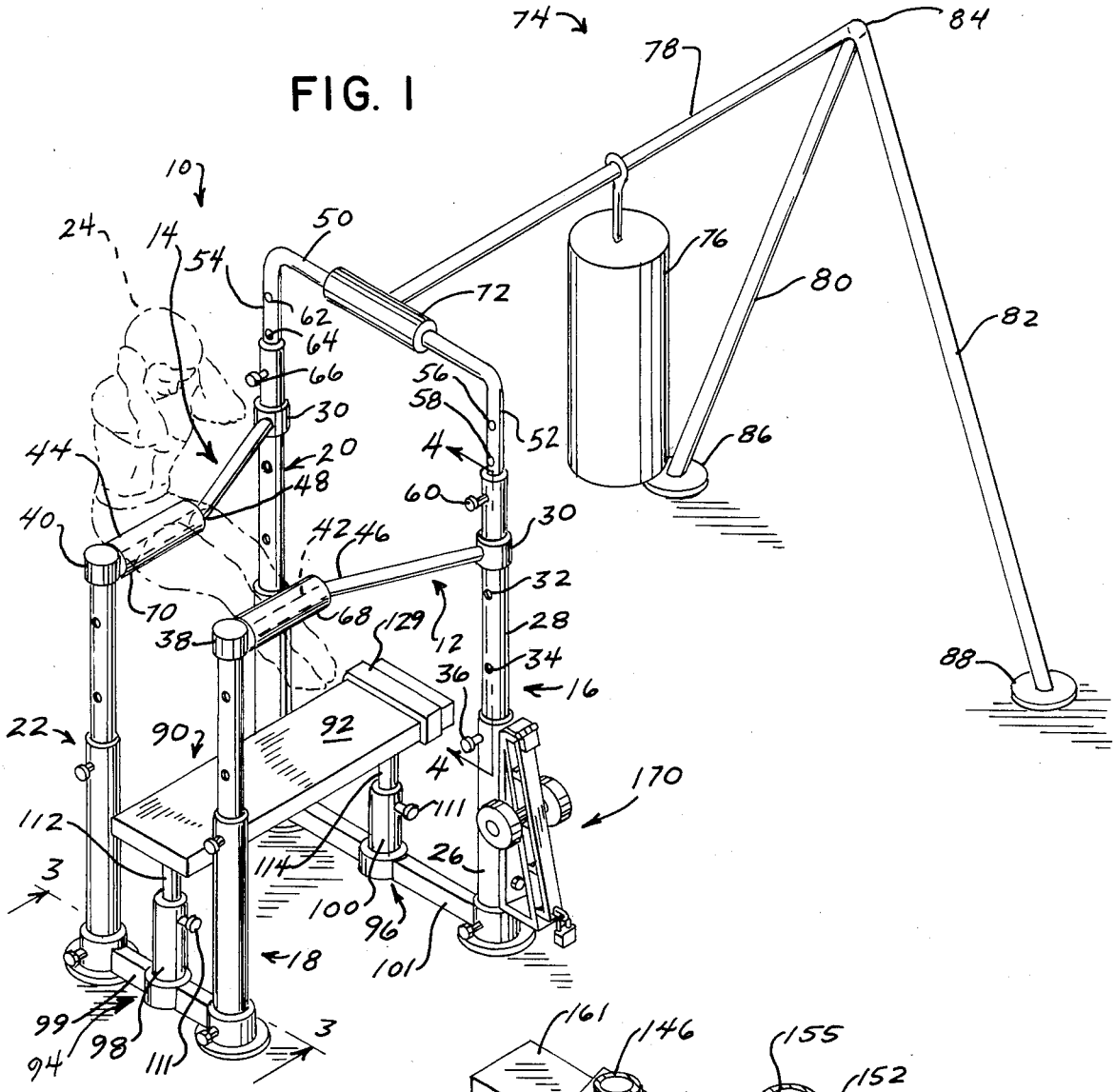
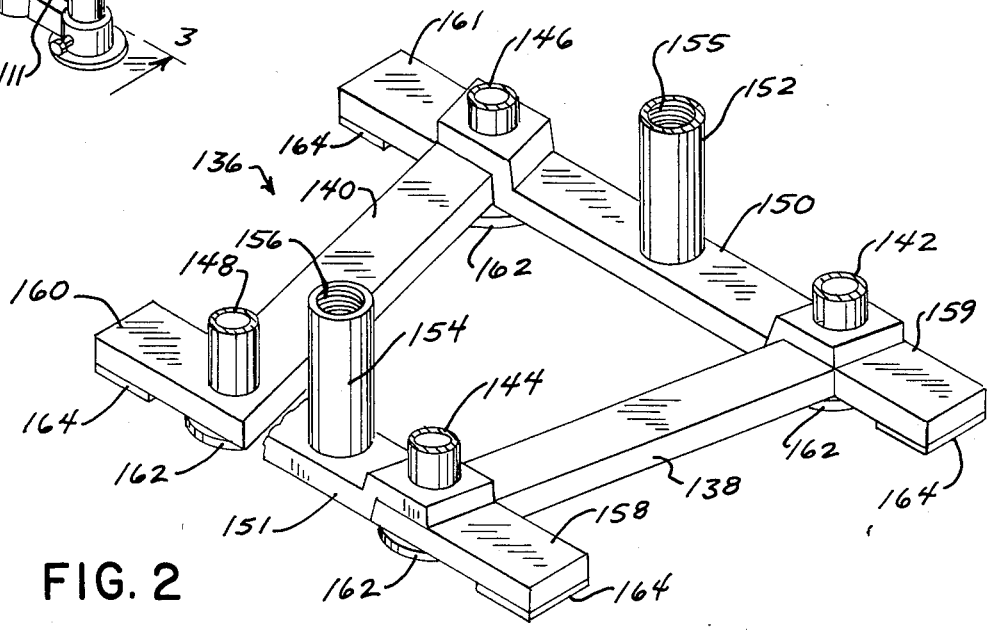
FIG. 2

FIG. 3
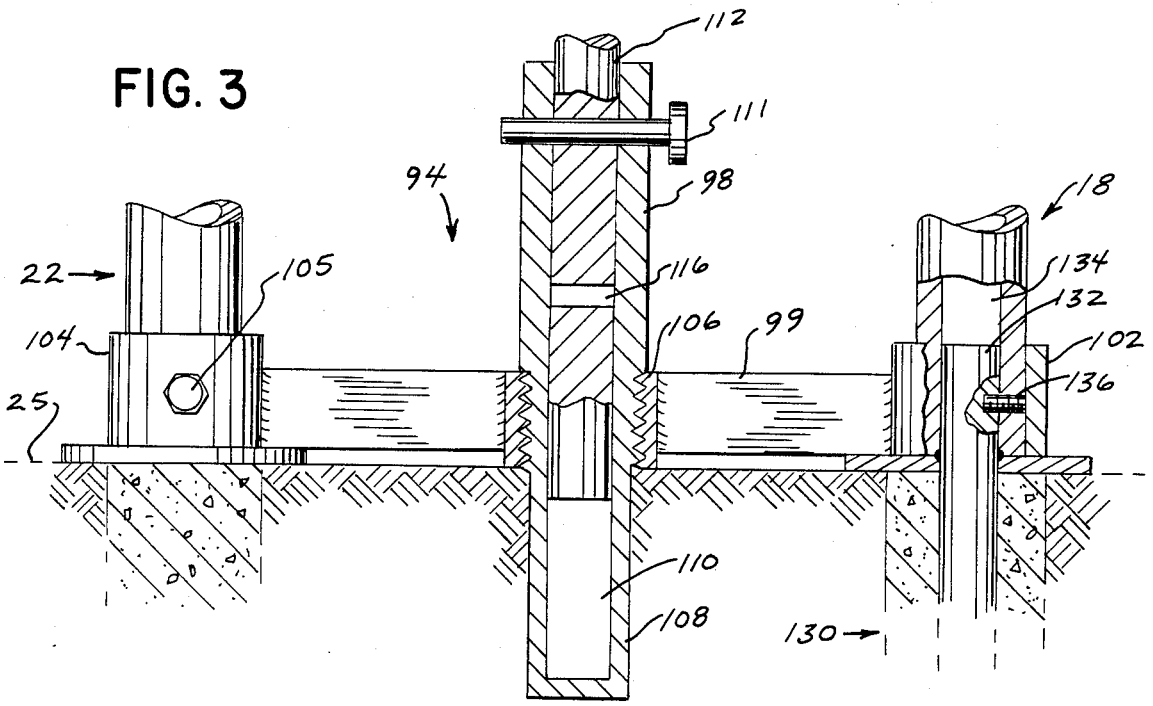
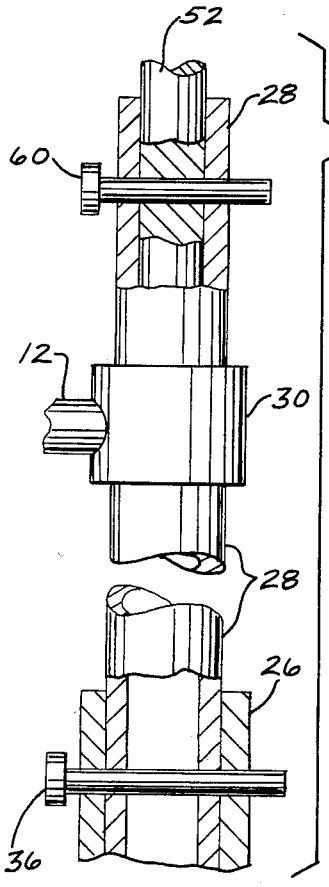
FIG. 4
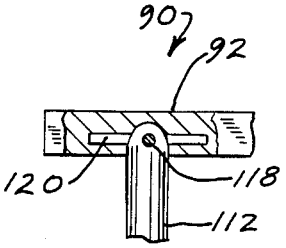
FIG. 5
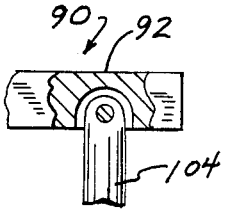
FIG. 6
FIG. 7
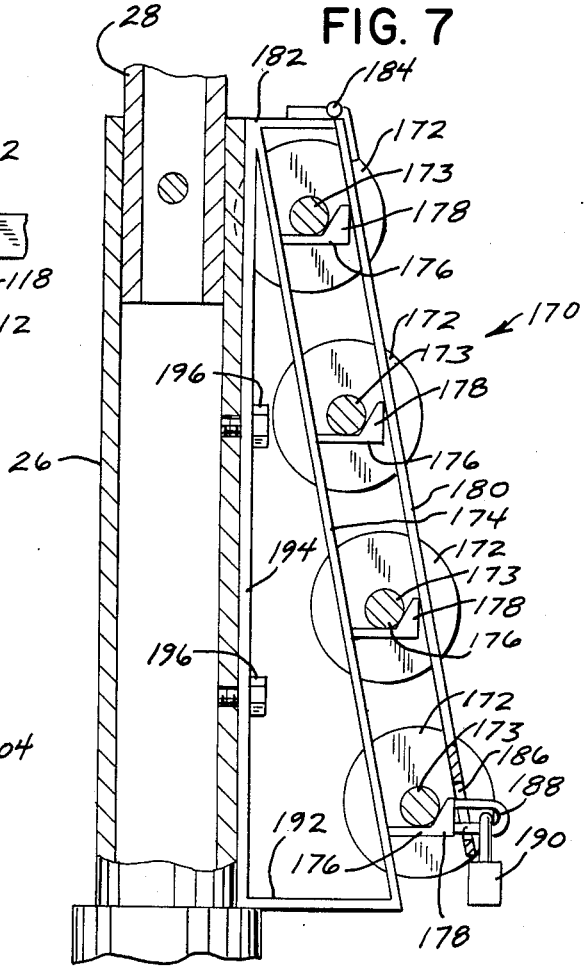

EXERCISE DEVICE

BACKGROUND AND SUMMARY

The present invention relates to exercise devices, and more particularly to an exercise device for improving the muscle tone and overall condition of an exerciser.

It is known to provide exercise devices in which the resistance for an exerciser is in the form of weights or other mechanical devices which provide resistance for an exerciser during performance of a series of exercises. The present invention is intended to reduce reliance on weights or other mechanical devices for providing resistance during exercise, and instead utilizes the weight of the exerciser's body as resistance during performance of exercises.

The invention provides a pair of spaced side rails, with each rail supported so as to be capable of bearing the weight of an exerciser along its length. Each side rail is supported by a pair of supporting posts, which space the side rail above a supporting surface. The side rails are disposed so as to be closer together at one end than at the other. In one embodiment, the side rails extend in parallel relation along a portion of their length from one end, after which the side rails diverge toward the other end, thus forming an elbow. The supporting posts are capable of adjustable up-down movement relative to the supporting surface, so that the height of the side rails above the supporting surface may be varied. A transverse end rail extends between the side rails at one end thereof. The transverse end rail is preferably supported by the support posts at one end of the side rails, and is connected thereto so as to provide adjustable up-down movement relative to the side rails. The lower ends of the support posts are connected to a base means adjacent the supporting surface, for providing a rigid anchor for the support posts and a stable support for the exercise device. In one embodiment, the support posts are substantially tubular in cross section, and the base means mates with the lower end of the tubular support posts to provide a rigid connection thereto. Two embodiments of the base means are disclosed, one of which is intended for indoor use and the other for outdoor use. An exercise bench is preferably included in the exercise device, and is disposed between the side rails at an elevation therebelow. The exercise bench is spaced above the supporting surface, and is provided with a mechanism for adjusting the height of the bench relative to the supporting surface. The invention also provides a dumbbell rack for connection to one or more of the support posts. The dumbbell rack includes a support element having a plurality of dumbbell-supporting arms extending therefrom for receiving the bar portion of a plurality of dumbbells, and is provided with a locking means for retaining the dumbbell bars on the dumbbell-supporting arms and preventing removal thereof when the dumbbells are not in use.

The invention thus provides an exercise device for use in both indoor and outdoor settings. The invention further provides an exercise device wherein the resistance provided for each exercise is the exerciser's weight, and wherein the intensity and level of stress produced by the exercise may be varied according to the varying heights of the side rails above the supporting surface and/or the bench, as well as by the varying height of the transverse end rail relative to the side rails.

The invention further provide an anti-theft dumbbell rack, for storage of dumbbells when not in use.

BRIEF DESCRIPTION OF THE DRAWINGS

The drawings illustrate the best mode presently contemplated of carrying out the invention.

In the drawings:

FIG. 1 is an isometric view of the exercise device of the present invention, showing its use in an outdoors environment;

FIG. 2 is an isometric view of a base for the exercise device of FIG. 1 for use indoors;

FIG. 3 is a partial sectional view taken generally along lines 3—3 of FIG. 1;

FIG. 4 is a partial sectional view taken generally along lines 4—4 of FIG. 1;

FIG. 5 is a detail view of a connection for one end of an exercise bench as shown in FIG. 1;

FIG. 6 is a detail view of a connection for the other end of an exercise bench as shown in FIG. 1; and FIG. 7 is a side view partially in section of an anti-theft dumbbell rack according to the present invention.

DETAILED DESCRIPTION OF THE PREFERRED EMBODIMENT

As shown in FIG. 1, an exercise device 10 includes a pair of spaced side rails 12, 14. Side rail 12 is supported at its end by telescoping support posts 16, 18, and side rail 14 is supported at its ends by telescoping support posts 20, 22. Support posts 16–22 are disposed adjacent the ends of side rails 12, 14, and provide sufficient support for side rails 12, 14 so that each of rails 12, 14 is capable of supporting the weight of an exerciser 24 along its length.

Support posts 16–22 extend above a supporting surface 25, and space side rails 12, 14 thereabove. When exercise device 10 is outdoors, supporting surface 25 may be concrete or earth or the like. When exercise device 10 is indoors, supporting surface 25 may be any stable floor material, such as concrete or wood or the like.

Support post 26 includes a lower tubular sleeve member 26 and a telescoping upper tube member 28. Side rail 12 is connected adjacent the upper end of telescoping tube member 28 by means of a stationary collar 30. The ends of side rail 12 may be connected to collar 30 using any suitable connecting means, such as by welding or the like. Collar 30 is preferably fixedly connected adjacent the upper end of telescoping tubular member 28, again such as by welding or the like. Alternatively, collar 30 may be eliminated and the end of side rail 12 connected directly to telescoping tubular member 28 adjacent its upper end.

Telescoping tubular member 28 is provided along its length with a series of openings such as 32, 34. Lower tubular sleeve member 26 is provided adjacent its upper end with a pin 36 extending therethrough via an opening provided in each side thereof. As seen in FIG. 4, by lining up a selected opening in telescoping tube member 28, such as 32, 34, with the opening in lower tubular sleeve member 26 through which pin 36 extends, and by inserting pin 36 therethrough, the height of the end of spaced side rail 12 may be adjusted up and down relative to supporting surface 25.

Referring again to FIG. 1, each of supporting posts 18, 20 and 22 are provided with a lower tubular sleeve member and an upper telescoping tubular member mating with and extending from the lower sleeve member, identical to that shown at 26, 28 for support post 16. Support posts 18–22 are also provided with a mating pin/hole arrangement for allowing the adjustable up-down movement of each end of side rails 12, 14.

Caps 38, 40 are provided at the tops of the upper telescoping tubular members of support posts 18, 22, respectively. Caps 38, 40 may be connected to the telescoping upper tubular members by any satisfactory means, such as by welding or the like. The ends of spaced side rails 12, 14 are connected to caps 38, 40, respectively, by any suitable means, again such as be welding or the like.

As shown in FIG. 1, spaced side rails 12, 14 include substantially parallel portions 42, 44 extending from caps 38, 40, respectively. At a point intermediate their lengths, spaced side rails 12, 14 form elbows 46, 48. For the remainder of their lengths, spaced side rails 12, 14 diverge toward the collars connecting their ends to the telescoping upper tubular members of support posts 16, 20, respectively.

Referring to FIG. 1, a transverse end rail 50 is provided above support posts 16, 20 at the divergent ends of spaced side rails 12, 14. Transverse end rail 50 is provided with depending end portions 52, 54, which are adapted to mate with the passage provided in the telescoping upper tube member provided at support posts 16, 20.

Depending end portion 52 is provided with a series of openings, such as 56, 58, and end portion 54 has a series of openings such as 62, 64. A pin 60 is provided in an opening adjacent the top of telescoping upper tubular member 28 of support post 16, and a pin 62 is provided in an opening adjacent the top of telescoping upper tubular member of support post 20. Like the height of spaced side rails 12, 14 above supporting surface 25, the height of transverse end rail 50 above spaced side rails 12, 14 is adjustable using such a pin/opening arrangement.

Side rails 12, 14 and end rail 50 are preferably provided with exercise pads 68, 70 and 72, respectively. Pads 68–72 are preferably movable along the length of each rail, to positions selected by the exerciser.

A support 74 may be provided for a punching/kicking bag 76. Support 74 includes a cross member 78 and end support members 80, 82 for spacing cross member 78 above supporting surface 25. A knuckle joint 84 is provided at the juncture of cross member 78 with end support members 80, 82. A rotatable joint is also provided at the connection of cross member 78 to transverse end rail 50. These joints accommodate the adjustable up-down movement of transverse end rail 50. End supports 80, 82 include feet 86, 88, respectively, for providing a stable base for end supports 80, 82. Feet 86, 88 are preferably rigidly secured to supporting surface 25 to prevent movement of end supports 80, 82 during use of bag 76.

The structural members discussed above may be fabricated from any suitable material, such as PVC pipe, galvanized steel or stainless steel.

As shown in FIG. 1, a bench 90 is disposed between spaced side rails 12, 14. Bench 90 includes an exercise surface 92, which is usable by an exerciser for a variety of exercises, as will be explained.

During outdoor use of exercise device 10, bench 90 is supported by a pair of bench brackets 94, 96. As shown in FIG. 1, bracket 94 is provided with a substantially central upstanding tubular bench support 98 connected to a cross member 99, and bracket 96 is likewise provided with an upstanding tubular bench support 100 connected to a cross member 101.

As shown in FIG. 3, cross member 99 is provided at its ends with collars 102, 104, respectively, which are adapted to receive the lower ends of the tubular sleeve members of support posts 18, 22, respectively. Each of collars 102, 104 are provided with retainer bolts, such as 105, to affix collars 102, 104 to the lower ends of the tubular sleeve members of support posts 18, 22.

A threaded collar 106 is substantially centrally located along the length of cross member 99. Collar 106 is provided with a set of internal threads, which are adapted to mate with a set of external threads provided on upstanding tubular bench support 98. A lower tubular portion 108 extends below the threaded portion of upstanding tubular bench support 98. In the outdoor configuration shown in FIG. 3, lower tubular portion 108 extends below supporting surface 25 and is embedded therein. Lower tubular portion 108 includes a passage 110. Upstanding tubular bench support 98 is provided adjacent its upper end with an opening which accommodates passage of a pin 111 therethrough.

Bench 90 has a pair of depending legs 112, 114 adapted for insertion in the passages provided in upstanding tubular bench supports 98, 100 and to mate therewith. Legs 112, 114 are slidable within the passages of upstanding tubular bench supports 98, 100, for providing an adjustable height for exercise surface 92 of bench 90. Legs 112, 114 are provided with a series of passages, such as 116 (FIG. 3), which are engageable by pin 111 for fixing the height of leg 112 at a selected position above supporting surface 25.

As shown in FIG. 5, depending leg 112 is connected to bench 90 by means of a sliding connection to allow bench 90 to be positioned at an angle relative to the supporting surface. That is, one end of bench 90 may be elevated higher or lower than the other end of bench 90, due to the sliding connection shown in FIG. 5. A pin 118 extends through the upper end of depending leg 112, and is disposed within a slot 120 provided in bench 90. At the other end of bench 90, a pivotable connection as shown in FIG. 6 is provided.

The invention provides an exercise device for use in connection with a number of exercises. As noted previously, the primary resistance for the exercises is the weight of the exerciser's own body. As shown in FIG. 1, an exerciser 24 may use exercise device 10 by performing sit-ups using rails 12 and 14. To accommodate a taller exerciser, the exercise may be performed using the diverging portions of rails 12 and 14. Easier sit-ups may be performed by using exercise bench 90 either inclined or declined, with the assistance of a sit-up strap, as shown at 129. The difficulty of the sit-ups may be varied by placement of the hands. Chin-ups and pull-ups may be performed using transverse end rail 50. Upper bar rows may be performed by placing the feet on side rails 12, 14 and grasping end rail 50 from below so that the exerciser is facing upward. From that position, the exerciser pulls so as to raise his neck or chest to the level of end rail 50, and then returns to the original position and repeats. Lower bar rows may be performed by placing the feet on side rails 12, 14 adjacent support posts 16, 20 and the hands on rails 12, 14 adjacent end caps 38, 40. In this position, the exerciser is facing upward, and the exercise is performed by pulling up to the plane of side rails 12, 14. The difficulty of the exercise may be increased by reversing the position of the hands and feet, so that the exerciser grasps the diverging portions of side rails 12, 14. Hype--extensions may be performed by placing the thighs on pad 44 of side rail 14 and hooking the heels below pad 42 of side rail 12. From this position, the exerciser raises and lowers his upper body to exercise the erectorspinae muscles. Easier versions of this exercise may be performed using bench 90, by lying face down on exercise surface 92 and raising head and heels and returning to the original position. Leg raisers may be performed by placing the hands on side rails 12 and 14, with arms straight and the body suspended between rails 12 and 14, and then raising the legs to a plane substantially parallel to that of rails 12 and 14. Leg raisers may also be performed by grasping end rail 50 with the body suspended between support posts 16 and 20, and raising the legs between side rails 12 and 14. Easier leg raisers may be performed using bench 90. Dips may be performed using the same body placement, but instead raising and lowering the body with the arms. The degree of difficulty of this exercise is governed by the distance between the hands. To increase difficulty, the exerciser performs the dips using the diverging portions of side rails 12, 14. Push-ups may be done in one of two ways. First, the exerciser places the feet on rails 12 and 14 adjacent caps 38 and 40 and the hands on end rail 50. The height of end rail 50 above side rails 12 and 14 governs the difficulty of the exercise. Second, the exerciser reverses the positions of the feet and hands, so that the head is adjacent support posts 18, 22. This is a more difficult form of push-up, and again can be controlled by the height of end rail 50 relative to side rails 12, 14. Squats may be performed by placing the hands on end rail 50 and the feet on side rails 12, 14. The feet may be placed adjacent support posts 16, 20, or adjacent elbows 46, 48, or adjacent caps 38, 40, depending on the muscle group desired to be exercised. An inverted shoulder press may be performed by placing the hands on rails 12, 14 adjacent caps 38, 40 and the feet on rails 12, 14 adjacent support posts 16, 20, and facing downward so that the legs and upper body of the exerciser form a V-shape. The exerciser then lowers his upper body to the plane of side rails 12, 14, and then returns to an incline position. The difficulty of this exercise may be increased by reversing the position of the hands and feet. The bench 90 may be used for dumbbell exercises, such as flys. The bench 90 may also be provided with a leg curl apparatus (not shown), for performing a variety of leg-related exercises.

Exercise device 10 is adapted for use both indoors and outdoors, and the invention provides suitable supports for either such use. As shown in FIG. 3, a base for providing a rigid support to the upstanding support posts 18–22 includes an anchor portion 130 disposed below supporting surface 25, which may be formed from concrete or any other suitable foundation material. Anchor 130 is provided with an upstanding member 132 rigidly secured thereto, which projects above supporting surface 25 and the top of anchor portion 130. Projecting member 132 is adapted to mate with the internal passage provided in the lower tubular sleeve member of upstanding post 118, shown in FIG. 3 as 134. An Allen screw 136 extends through the wall of the upstanding tubular sleeve member and into an opening disposed in projecting member 132, to fixedly secure the lower end of the tubular sleeve member to projecting member 132, and thereby to anchor 130. Such a connection is provided at the lower end each of upstanding support posts 16–22, to provide a substantially rigid support for exercise device 10 above supporting surface 25.

When it is desired to use exercise device 10 indoors, a free standing base 136 (FIG. 2) is employed. Base 136 includes a pair of spaced side members 138, 140, which are provided at their ends with upstanding pins 142, 144 and 146, 148, respectively. Pins 142–148 are adapted to receive the lower ends of the tubular sleeve members of support posts 16–22, respectively. As above, an Allen screw extends through the wall of the tubular sleeve members to secure the lower ends of the tubular sleeve members to pins 142–148.

A cross member 150 spans between the ends of side members 138, 140 containing pins 142 and 146, respectively. A cross member 151 spans between the ends of side members 138, 140 containing pins 144, 148 respectively, and is provided with openings to accommodate the passage of pins 144, 148 therethrough. The ends of cross member 150 are provided with openings to accommodate the passage of pins 142 and 146 therethrough.

Cross members 150 and 151 are preferably provided at their central portions with upstanding receptors 152, 154 to support bench 90. Receptors 152 and 154 each have an axial passage adapted to receive the lower tubular portions, such as 108, of tubular bench supports 98, 100. Receptor 152 has a set of internal threads 155 adapted to mate with the external threads provided on tubular bench support 98. Likewise, receptor 154 has a set of internal threads 156 adapted to mate with the external threads provided on tubular bench support 100. Upon placement of lower tubular bench supports 98, 100 within the axial passages of receptors 152, 154, the elevation of bench 90 above supporting surface 25 may be regulated as described above by varying the amount of extension of depending legs 112, 114 above tubular bench supports 98, 100. Side member 138 is provided with outriggers 158, 159 at its ends, and side member 140 is provided with outriggers 160, 161 at its ends. Outriggers 158–161 act to stabilize free standing base 136 during indoor use of exercise device 10.

Each corner of free standing base 136 is provided with a padded foot 162, which are placed below side members 138, 140 at each end thereof beneath the pin located at the respective end. Similarly, outriggers 158–161 are provided with pads 164. Pads 162 and 164 prevent marring of supporting surface 25 during indoor use of exercise device 10, and also provide an anti-skid base for exercise device 10.

As shown in FIG. 7, the invention includes an anti-theft dumbbell rack 170 for outdoor use of exercise device 10. Dumbbell rack 170 is intended for storage of weights, such as dumbbells 172 having bar portions 173, both during use and when not in use. Dumbbell rack 170 includes a support member 174 having a plurality of dumbbell-supporting arms 176 extending outwardly therefrom. Arms 176 are connected to support member 174 by any suitable means, such as by welding or the like. Each arm 176 includes an upstanding portion 178 at its end spaced from support member 174. As can be seen, this arrangement creates a cradle for receiving the bar portions 173 of dumbbells 172.

A locking bar 180 is pivotably connected at the top of dumbbell rack 170 by means of an extender plate 182 and a hinge 184. Locking bar 180 is provided at its lower end with a slot 186, which is adapted to receive a U-shaped latch 188 extending outwardly from the lowermost dumbbell-supporting arm 176 and connected to upstanding portion 178 thereof.

Locking bar 180 is pivotable between a first closed position, shown in FIG. 7, wherein bar 180 is adjacent the upstanding portions 178 of dumbbell-supporting arms 176 throughout its length, and a second open position (not shown) wherein bar 180 is pivoted upwardly so as to be substantially vertical and to allow bar portions 173 of dumbbells 172 to be removed from bar-supporting arms 176. When bar 180 is in its closed position, a lock 190 may be secured to latch 188 to retain bar 180 in its closed position. In this manner, when exercise device 10 is in an outdoor environment, dumbbells 172 may be secured to exercise deice 10 during periods of nonuse.

Dumbbell rack 170 is preferably connected to the lower tubular sleeve member, such as 26, of a support post, such as 16, in such a manner so that the dumbbells do not present an obstruction to any exercises, as shown in FIG. 1. Referring to FIG. 7, the lower end of support member 174 may be spaced from lower tubular sleeve member 26 by a spacer bar 192, which is connected to the lower end of a connector member 194. Support member 174 is connected directly to connector member 194 at its top. Connector member 194 is adapted for connection to lower tubular sleeve member 26 of support post 16, by means of a pair of bolts 196.

Various alternatives are contemplated as being within the scope of the following claims particularly pointing out and distinctly claiming the subject matter regarded as the invention.

I claim:

1. An exercise device, comprising:

a bench having a substantially planar upper surface supported above and supporting surface;

a pair of spaced side rails supported above said upper surface of said bench, each said side rail being supported so as to bear the weight of an exerciser along its length, said side rails extending throughout a major portion of the length of said bench and being closer together at one end than at the other end, said side rails being supported so as to be spaced a substantially equal distance above said upper surface of said bench and being disposed in a plane substantially parallel thereto; and a transverse end rail adapted to bear the weight of an exerciser along its length, said end rail being disposed above said upper surface of said bench and extending between said spaced side rails adjacent an end thereof and being disposed in a plane substantially parallel to that of said side rails and said upper surface of said bench and being capable of adjustable up-down movement relative to said spaced side rails and said upper surface of said bench.

2. The invention according to claim 1, wherein said spaced rails are substantially parallel along a portion of their length from one end, and then diverge toward the other end to form an intermediate elbow along each said side rail.

3. The invention according to claim 1, wherein said transverse end rail extends between said spaced side rails at an end thereof and is disposed above said side rails, and wherein said transverse end rail is adjustably positionable above said side rails.

4. The invention according to claim 3, wherein said spaced side rails are closer together at one end than at the other end to thereby provide a convergent end and a divergent end, and wherein said transverse end rail extends between the divergent end of said spaced side rails.

5. The invention according to claim 4, wherein said transverse rail is substantially parallel to a line extending between the convergent ends of said spaced rails.

6. The invention according to claim 1, wherein said spaced side rails are supported so as to be adjustably positionable at varying heights above said supporting surface and thereby above said upper surface of said bench.

7. The invention according to claim 1, wherein said bench is supported such that the elevation of said upper surface of said bench above said supporting surface is adjustably positionable to varying heights.

8. The invention according to claim 1, further comprising a punching bag apparatus connected to said exercise device.

9. An exercise device for indoor and outdoor usage, comprising:

a bench having a substantially planar upper surface;

a pair of spaced side rails disposed above said upper surface of said bench and extending throughout a major portion of the length of said bench, said side rails being closer together at one end than at the other end;

a pair of posts supporting each said side rail so that said each side rail is capable of bearing the weight of an exerciser along its length, said posts extending above a supporting surface for supporting said side rails thereabove;

base means for fixing the lower end of each said post adjacent said supporting surface to provide a stable support for said posts and to prevent movement of said posts relative to said supporting surface; and a transverse end rail adapted to bear the weight of an exerciser along its length, said end rail being disposed above said upper surface of said bench and extending between said spaced side rails adjacent an end thereof and being disposed in a plane substantially parallel to that of said side rails and said upper surface of said bench and being capable of adjustable up-down movement relative to said spaced side rails and said upper surface of said bench.

10. The invention according to claim 9, wherein said posts have a substantially tubular portion adjacent said supporting surface, and wherein said base means is adapted for outdoor use and comprises one or more rigid members disposed within said supporting surface and having an upstanding member disposed in said one or more rigid members, and wherein said upstanding members are adapted to mate with the tubular portions of said support posts adjacent said supporting surface for providing a rigid connection thereof to said supporting surface.

11. The invention according to claim 9, wherein said exercise device is adapted for indoor use, and wherein said base means comprises a stand adapted for placement on a floor or the like, said stand having a plurality of upstanding members adapted to mate with the lower end of each said supporting posts, and wherein each said upstanding member is connected in a frame adapted for placement on said floor or the like to provide a rigid base for said exercise device.

12. An exercise equipment accessory, comprising:

one or more dumbbells, each having a bar portion with a weight member connected thereto adjacent its ends;

an elongated support member adapted for connection to a surface;

a plurality of bar-supporting arms connected to said support member and extending therefrom, each said bar-supporting arm being adapted to receive said bar portion of one of said dumbbells; and locking means for preventing removal of said dumbbells from said accessory when said dumbbells are not in use.

13. The invention according to claim 12, wherein said locking means comprises an elongated bar movably interconnected with said accessory between a locking position in which said bar is disposed adjacent the ends of said arms for retaining said dumbbells thereon, and an open position for allowing removal of said dumbbells from said arms.

14. The invention according to claim 13, wherein said bar is connected to said support member so as to be pivotable between said locking and opening positions.

15. The invention according to claim 14, wherein said bar is provided with a slot spaced from a hinged connection of said bar to said support member, and wherein said slot is adapted to receive a lock-receiving member provided at the end of one of said arms when said bar is in its locking position, and wherein said locking means further comprises a removable lock for connection to said lock-receiving member to retain said bar in said locking position.

16. An exercise device, comprising:

a pair of spaced side rails, each said side rail being supported at its ends by a support post so as to be capable of bearing the weight of an exerciser along its length, said side rails being substantially coplanar and spaced above a supporting surface by said support posts, with each said side rail being provided with a portion extending from an end thereof in parallel relation to each other and further being provided with diverging portions extending from said parallel portions toward the other end of said side rails, so that the ends of said side rails are closer together at one end than at the other and form an intermediate elbow therebetween;

said support posts being adjustably positionable so that said side rails may be spaced at varying heights above said support surface;

a transverse end rail extending between said side rails at the divergent end of said side rails and supported by said support posts, said transverse end rail being adjustably positionable at selective heights above said side rails;

base means for providing a rigid support of said support posts to said supporting surface;

a bench including an exercise surface disposed between said side rails at an elevation therebelow, said bench being adjustably positionable to selective heights above said supporting surface; and a dumbbell rack adapted for connection to one of said support posts for storing one or more dumbbells having a weight portion and a bar portion, said rack including a support member having a plurality of dumbbell-supporting arms extending therefrom, with each said arm adapted to receive the bar portion of one of said dumbbells, said dumbbell rack including locking means for retaining said dumbbells on said dumbbell-supporting arms when said dumbbells are not in use.

* * * * *

UNITED STATES PATENT AND TRADEMARK OFFICE

CERTIFICATE OF CORRECTION

PATENT NO. : 4,789,152

DATED : December 6, 1988

INVENTOR(S) : Donato Rick Guerra

It is certified that error appears in the above-identified patent and that said Letters Patent is hereby corrected as shown below:

Claim 1, col. 7, line 33, Delete "and" and substitute therefor ---a---

Claim 14, col. 9, line 19, Delete "opening" and substitute therefor ---open---

Signed and Sealed this

Seventeenth Day of October, 1989

*Attest:*

DONALD J. QUIGG

*Attesting Officer*

*Commissioner of Patents and Trademarks*